US012716688B1

(12) United States Patent
Freeny

(10) Patent No.: US 12,716,688 B1
(45) Date of Patent: Aug. 25, 2026

(54) FIREARM-SCOPE-ATTACHABLE DIOPTER LENS DEVICE

(71) Applicant: Alfred Freeny, Ackerman, MS (US)

(72) Inventor: Alfred Freeny, Ackerman, MS (US)

( * ) Notice: Subject to any disclaimer, the term of this patent is extended or adjusted under 35 U.S.C. 154(b) by 0 days.

(21) Appl. No.: 19/206,839

(22) Filed: May 13, 2025

Related U.S. Application Data

(60) Provisional application No. 63/763,343, filed on Feb. 26, 2025.

(51) Int. Cl.
*F41G 1/38* (2006.01)
*F41G 11/00* (2006.01)

(52) U.S. Cl.
CPC ..... *F41G 1/38* (2013.01); *F41G 11/00* (2013.01)

(58) Field of Classification Search
CPC ..... F41G 1/383
See application file for complete search history.

(56) References Cited

U.S. PATENT DOCUMENTS 5,430,967 A 7/1995 Woodman, III
5,495,676 A * 3/1996 Chesnut ..... F41G 1/383 42/129
6,508,026 B1 1/2003 Uppiano
8,151,508 B1 4/2012 Moore
9,612,088 B2 4/2017 Theriault
9,945,639 B1 * 4/2018 Geraci ..... G02B 27/0025
11,150,053 B1 * 10/2021 Dunning ..... F41G 1/383
11,193,733 B2 * 12/2021 Vandamia ..... G02C 5/003
2002/0041440 A1 * 4/2002 Cross ..... G02B 1/115 359/581
2002/0167731 A1 * 11/2002 Watson ..... G02B 23/16 359/511
2006/0201047 A1 9/2006 Lowrey, III
2006/0218841 A1 * 10/2006 Campean ..... G02B 23/16 42/129
2008/0186584 A1 * 8/2008 Ballard ..... F41G 1/383 359/511
2009/0049733 A1 2/2009 Matthews
2018/0092534 A1 * 4/2018 Nabhan ..... G16H 30/20
2019/0331457 A1 * 10/2019 Vandamia ..... F41G 1/38

* cited by examiner

*Primary Examiner* — Jonathan C Weber
(74) *Attorney, Agent, or Firm* — Brennan, Manna & Diamond, LLC

(57) ABSTRACT

A firearm-scope-attachable diopter lens device is provided. The device is comprised of an eyepiece-mounted optical accessory configured to affix securely over the eyepiece of a standard firearm scope without requiring any permanent modification to the scope itself. The device comprises a housing with at least one optically-aligned diopter lens, available in a range of diopter strengths to correct myopia, hyperopia, or astigmatism. In certain embodiments, the lens is installed in a removable cartridge that interfaces with the housing via a fastener such as a magnetic ring, twist-lock, or bayonet mechanism. Selective lens tinting may be applied to enhance contrast and reduce glare in varying light conditions. An optional micro-adjustment ring concentrically aligned with the lens permits fine diopter calibration in increments of ±0.25 diopters. A protective flip-up cap with a silent hinge mechanism and optional locking feature is integrated to shield the lens from debris when not in use.

18 Claims, 3 Drawing Sheets

FIREARM-SCOPE-ATTACHABLE DIOPTER LENS DEVICE

CROSS-REFERENCE TO RELATED APPLICATION

The present application claims priority to, and the benefit of, U.S. Provisional Application No. 63/763,343, which was filed on Feb. 26, 2025, and is incorporated herein by reference in its entirety.

FIELD OF THE INVENTION

The present invention relates generally to the field of firearm scopes. More specifically, the present invention relates to an eyepiece-mounted optical accessory that affixes securely over a standard firearm scope eyepiece without requiring permanent modification and includes a housing with at least one optically aligned diopter lens. Accordingly, the present disclosure makes specific reference thereto. Nonetheless, it is to be appreciated that aspects of the present invention are also equally applicable to other like applications, devices, and methods of manufacture.

BACKGROUND

Individuals who require reading glasses often experience significant difficulty using standard rifle scopes due to an inability to focus on the eyepiece. This visual limitation reduces shooting accuracy and overall performance in both recreational and professional settings. The optical misalignment between corrective eyewear and scope design can create parallax errors, visual discomfort, and delayed target acquisition. Standard scopes are typically engineered without consideration for users with refractive impairments such as myopia or presbyopia. As a result, individuals who rely on reading glasses may be forced to compromise between corrective vision and proper scope alignment. Wearing glasses while using a scope can also introduce physical interference, such as improper eye relief or eyeglass slippage, further reducing accuracy. There is a notable lack of integrated or user-adaptable solutions on the market that accommodate the vision needs of nearsighted users in shooting environments. This problem is especially pronounced during outdoor activities like hunting, where rapid target acquisition and environmental clarity are essential. A device that corrects visual impairments without requiring permanent scope modification or the use of external eyewear is therefore necessary.

Therefore, there exists a long-felt need in the art for a firearm-scope-attachable diopter lens device that enables individuals with refractive vision impairments to clearly view through a rifle scope without the use of reading glasses. There also exists a long-felt need in the art for a firearm-scope-attachable diopter lens device that provides improved image clarity, brightness, and target contrast for users in diverse environmental conditions. Moreover, there exists a long-felt need in the art for a firearm-scope-attachable diopter lens device that offers modularity, quick installation, and durable performance across a range of shooting scenarios.

The subject matter disclosed and claimed herein, in one embodiment thereof, comprises a firearm-scope-attachable diopter lens device. The device is comprised of an eyepiece-mounted optical accessory configured to affix securely over the eyepiece of a standard firearm scope without requiring any permanent modification to the scope itself. The device comprises a housing with at least one optically-aligned diopter lens, available in a range of diopter strengths to correct myopia, hyperopia, or astigmatism. In certain embodiments, the lens is installed in a removable cartridge that interfaces with the housing via a fastener such as a magnetic ring, twist-lock, or bayonet mechanism. Selective lens tinting may be applied to enhance contrast and reduce glare in varying light conditions. An optional micro-adjustment ring concentrically aligned with the lens permits fine diopter calibration in increments of ±0.25 diopters. A protective flip-up cap with a silent hinge mechanism and optional locking feature is integrated to shield the lens from debris when not in use.

In this manner, the firearm-scope-attachable diopter lens device of the present invention accomplishes all the foregoing objectives and provides a vision-correcting optical accessory that securely attaches to a firearm scope without altering the scope itself. The optically aligned diopter lens corrects for common refractive errors, thereby eliminating the need for external eyewear and improving shooting accuracy. The modular lens system and optional micro-adjustment ring allow users to customize optical performance based on individual vision requirements. Environmental enhancements such as lens coatings and tint options ensure reliable performance under diverse field conditions. The snap-fit housing and protective cap contribute to ease of use, quick installation, and long-term durability. Collectively, these features address the limitations encountered by nearsighted individuals using conventional scopes and enable a clearer, more efficient, and safer shooting experience.

SUMMARY

The following presents a simplified summary to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a firearm-scope-attachable diopter lens device. The device is an eyepiece-mounted optical accessory configured to fit securely over a standard firearm scope eyepiece without requiring modification to the scope, incorporating a diopter lens to enhance scope visibility, target acquisition accuracy, and user comfort by removing the need for corrective eyewear.

The device is comprised of a housing. Attachment of the housing to the scope eyepiece may be achieved through a snap-fit interface utilizing features such as an annular retention lip or inward-projecting tabs that apply radial pressure. Alternate configurations may include compressive fit or friction-lock mechanisms to accommodate different scope designs while allowing for quick installation and removal.

An optically aligned diopter lens is centrally mounted within the housing along the optical axis to reduce image distortion and parallax. The lens provides corrective focus for visual impairments such as myopia, hyperopia, or astigmatism, with options ranging from, but not limited to, −6.00 diopters to +3.00 diopters. The diopter lens may feature selective tinting, including amber, green, or smoke gray, to enhance contrast, reduce eye fatigue, and improve visibility under specific lighting conditions. In certain embodiments, the diopter lens is installed in a removable cartridge that fits within the housing and is secured using a fastener such as a magnetic retention ring, bayonet-locking interface, or twist-lock mechanism, enabling modularity and user-specific customization.

A micro-adjustment ring may be concentrically integrated with the lens, permitting fine-tuned diopter adjustment in increments of ±0.25 diopters or finer. The ring is fabricated from rigid materials such as anodized aluminum, glass-filled nylon, or stainless steel, with a grip-enhancing surface treatment such as knurling or rubber overmolding for operation in adverse conditions.

To preserve optical clarity in varying environments, the diopter lens may be treated with multiple coatings, including an anti-fog coating on the inner surface, a hydrophobic outer coating, and a hard-coated layer for abrasion resistance, applied in multilayer deposition formats.

A protective flip-up cap may be integrated into or mounted onto the housing to shield the lens from contaminants. The cap operates on a silent hinge mechanism with a spring-damped or friction-based articulation and includes a detent or over-center lock to secure open or closed positions, along with a locking feature to prevent accidental opening.

A method of using the device comprises providing the device with its housing, snap-fit attachment, diopter lens, and flip-up cap, aligning and securing the housing to a firearm scope eyepiece, optionally inserting a removable cartridge with the desired lens and securing it, adjusting the diopter setting via the micro-adjustment ring, closing and securing the flip-up cap during transport, and opening the cap for use, allowing the user to aim through the device with built-in corrective vision.

Accordingly, the firearm-scope-attachable diopter lens device of the present invention is particularly advantageous as it provides a vision-correcting optical accessory that securely attaches to a firearm scope without altering the scope itself. The optically aligned diopter lens corrects for common refractive errors, thereby eliminating the need for external eyewear and improving shooting accuracy. The modular lens system and optional micro-adjustment ring allow users to customize optical performance based on individual vision requirements. Environmental enhancements such as lens coatings and tint options ensure reliable performance under diverse field conditions. The snap-fit housing and protective cap contribute to ease of use, quick installation, and long-term durability. Collectively, these features address the limitations encountered by nearsighted individuals using conventional scopes and enable a clearer, more efficient, and safer shooting experience to overcome the limitations of existing scopes known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
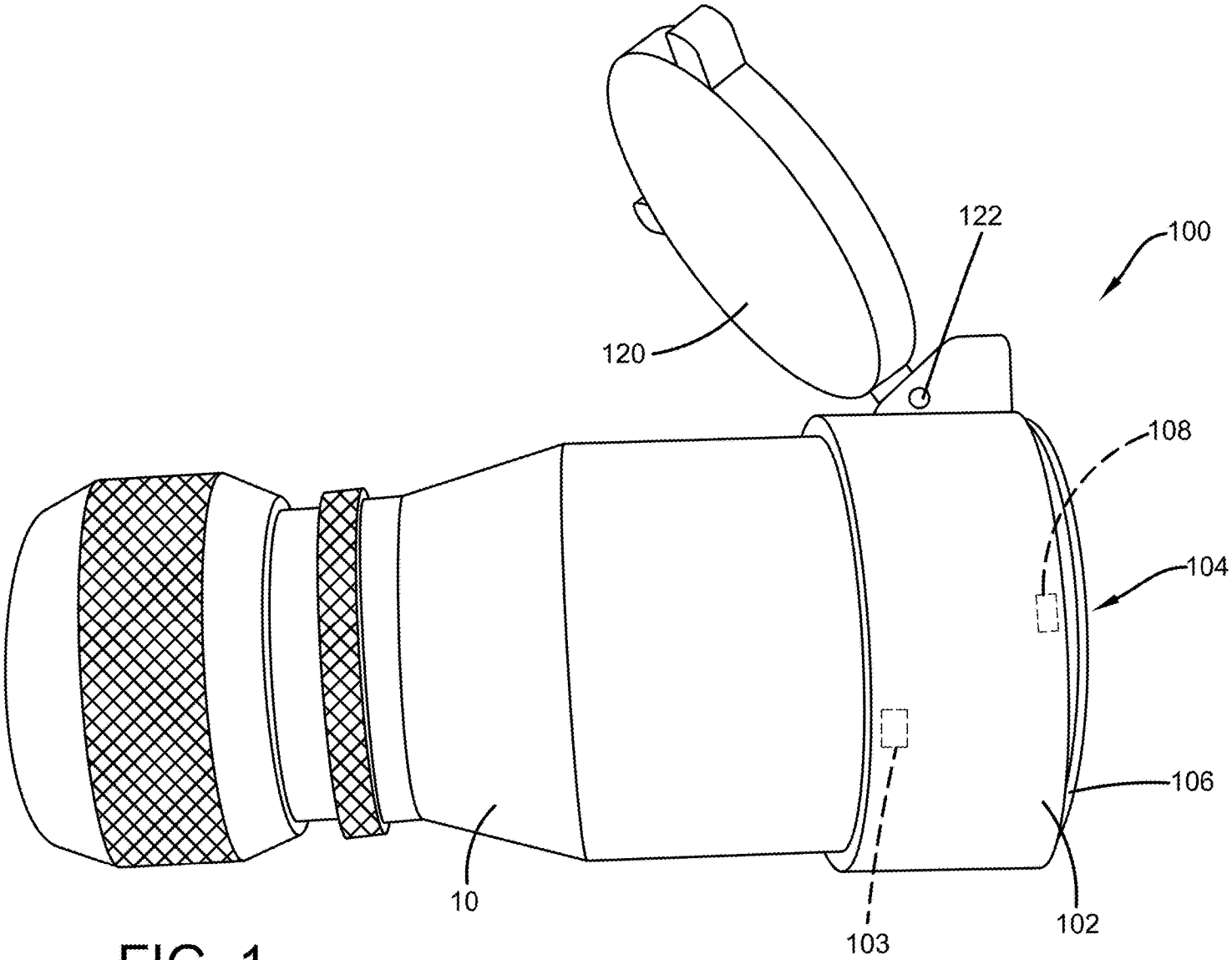
FIG. 1 illustrates a side perspective view of one potential embodiment of a firearm-scope-attachable diopter lens device of the present invention while open and while attached to the eyepiece of a firearm scope in accordance with the disclosed architecture.

The innovation is now described with reference to the drawings, wherein like reference numerals are used to refer to like elements throughout. In the following description, for purposes of explanation, numerous specific details are set forth to provide a thorough understanding thereof. It may be evident, however, that the innovation can be practiced without these specific details. In other instances, well-known structures and devices are shown in block diagram form to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for a firearm-scope-attachable diopter lens device that enables individuals with refractive vision impairments to clearly view through a rifle scope without the use of reading glasses. There also exists a long-felt need in the art for a firearm-scope-attachable diopter lens device that provides improved image clarity, brightness, and target contrast for users in diverse environmental conditions. Moreover, there exists a long-felt need in the art for a firearm-scope-attachable diopter lens device that offers modularity, quick installation, and durable performance across a range of shooting scenarios.

The present invention, in one exemplary embodiment, is comprised of a firearm-scope-attachable diopter lens device. The device is designed as an optical accessory mounted on the eyepiece of a standard firearm scope. It attaches securely without requiring any modification to the existing scope and integrates a diopter lens to improve visibility, targeting accuracy, and user comfort by eliminating the dependency on corrective eyewear.

The device is comprised of a housing that attaches to the firearm scope eyepiece using a snap-fit interface. This interface may incorporate an annular retention lip or inward-projecting tabs that apply radial pressure for secure engagement. Other configurations may include compressive or friction-lock mechanisms to accommodate various scope designs while enabling rapid installation and removal.

A diopter lens, aligned along the optical axis, is mounted centrally within the housing to minimize image distortion and parallax. This lens offers corrective focus for refractive vision impairments such as myopia, hyperopia, or astigmatism, with available options spanning from −6.00 diopters to +3.00 diopters. The lens may also include selective tinting, such as amber, green, or smoke gray, to improve contrast, reduce eye strain, and enhance visibility in specific lighting conditions. In certain embodiments, the lens is positioned within a removable cartridge, which is secured to the housing using a fastener such as a magnetic retention ring, bayonet-locking interface, or twist-lock mechanism, allowing for user customization and modular replacement.

A micro-adjustment ring may be positioned concentrically around the lens to enable precise diopter tuning in increments of ±0.25 diopters or finer. The adjustment ring is constructed from rigid materials such as anodized aluminum, glass-filled nylon, or stainless steel and features grip-enhancing treatments like knurling or rubber overmolding for reliable operation in difficult conditions.

To ensure consistent clarity in varying environmental conditions, the diopter lens may be treated with multiple coatings. These coatings include an anti-fog layer on the inner surface, a hydrophobic coating on the outer surface, and a hard-coated layer for abrasion resistance, all applied in multilayer formats to preserve optical performance.

A flip-up cap may be integrated into or attached to the housing to protect the lens from environmental contaminants. This cap may include a silent hinge mechanism, which could feature spring-damped or friction-based articulation, as well as a detent or over-center locking feature to hold it securely in open or closed positions. A locking element may also be included to prevent accidental cap movement during handling or transport.

A method of use involves providing the device with its primary components, aligning and securing the housing to a scope eyepiece, optionally inserting and securing the removable lens cartridge, adjusting the lens using the micro-adjustment ring, closing the flip-up cap for protection during transport, and opening it before use to enable vision correction through the scope.

Therefore, the firearm-scope-attachable diopter lens device provides a practical optical enhancement that mounts securely without altering the firearm scope. The inclusion of a corrective lens aligned to the scope's optical axis compensates for refractive vision errors, allowing users to shoot without external eyewear. Modular lens replacement and optional micro-adjustments facilitate user-specific tuning, while environmental coatings and tinting improve reliability across different field scenarios. The snap-fit housing and protective cap further contribute to ease of use, durability, and quick deployment, offering a clearer, safer, and more effective shooting experience compared to conventional scope solutions.

Referring initially to the drawings, FIG. 1 illustrates a side perspective view of one potential embodiment of a firearm-scope-attachable diopter lens device 100 of the present invention while open and while attached to the eyepiece of a firearm scope 10 in accordance with the disclosed architecture. The device 100 is comprised of an eyepiece-mounted optical accessory configured to fit securely over a standard firearm scope 10 eyepiece without requiring any modification to the scope itself, thereby integrating a diopter lens. The device 100 may be intended to improve scope visibility, target acquisition accuracy, and user comfort by eliminating the dependence on corrective eyewear during shooting activities.

The housing 102 of the device 100 may be comprised of a durable elastomeric material, such as, but not limited to, a silicone-polycarbonate blend, thermoplastic polyurethane (TPU), or high-durometer rubber compound. These materials may offer high elasticity and tear resistance, enabling the housing 102 to stretch slightly and return to its original shape, thereby providing a secure, form-fitting engagement with various diameters of eyepiece barrels.

The attachment of the housing 102 to the firearm scope eyepiece may be accomplished via a snap-fit interface. In one embodiment, the housing 102 has an attachment feature 103 such as an annular retention lip or inward-projecting tabs that engage with the scope 10 body, exerting uniform radial pressure to hold the accessory in place. In alternate implementations, the snap-fit may be complemented by a compressive fit or friction-lock engagement to accommodate variances in scope designs while preserving quick installation and removal.

At least one optically-aligned diopter lens 104 may be mounted centrally within the housing 102. The diopter lens 104 may be situated along the optical axis of the scope to ensure minimal image distortion or parallax. The lens 104 may provide corrective focus adjustment to compensate for refractive visual impairments such as myopia, hyperopia, or astigmatism. Optical strengths may be made available in a standard range, such as, but not limited to, −6.00 diopters to +3.00 diopters, with lens elements manufactured using high-index polycarbonate or lightweight optical glass to ensure clarity and impact resistance.

Figure 2:
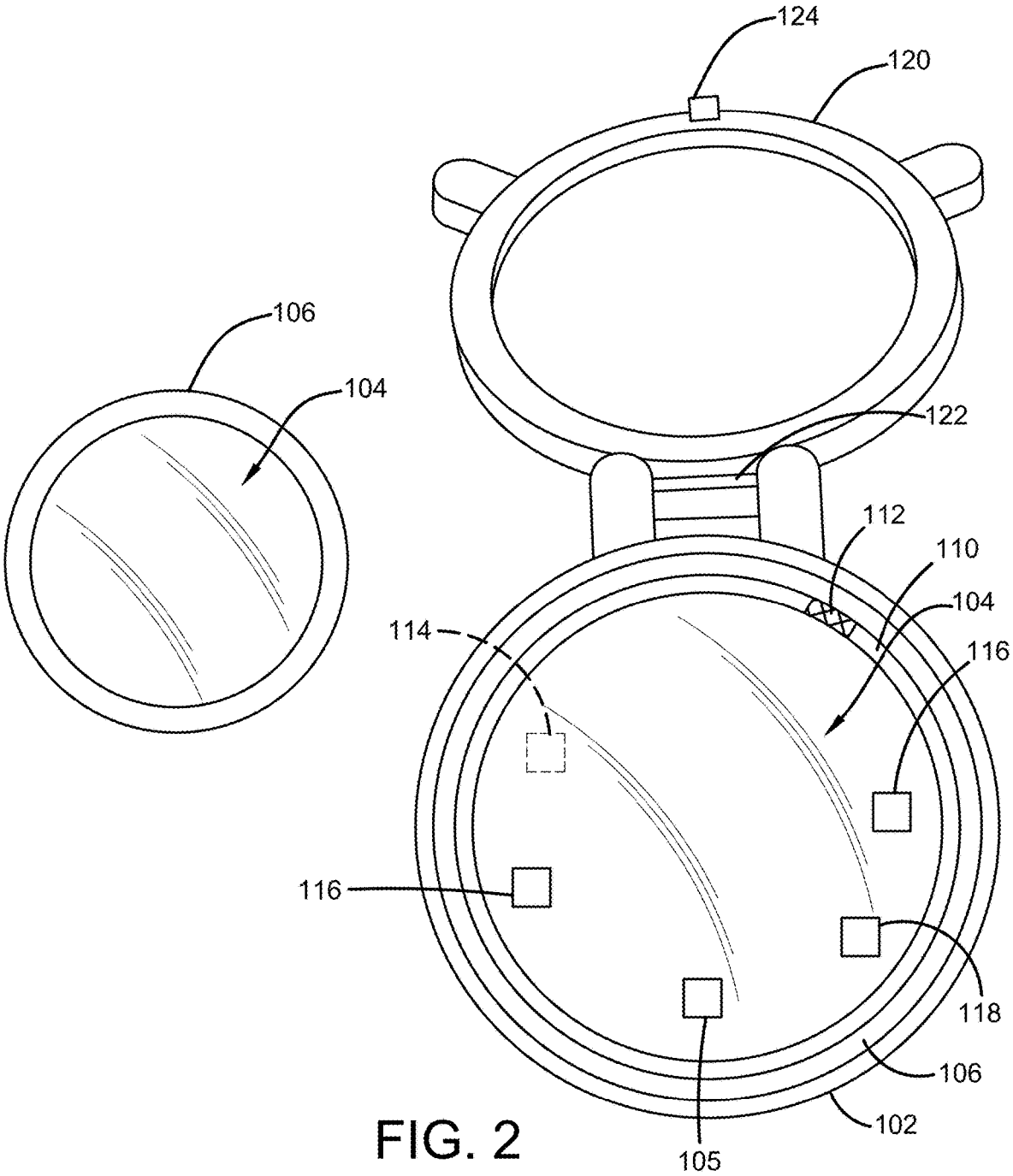
FIG. 2 illustrates a front perspective view of one potential embodiment of a firearm-scope-attachable diopter lens device of the present invention while open in accordance with the disclosed architecture.

In some configurations, the diopter lens 104 may be comprised of a selective tinting 105, as seen in FIG. 2. The tinting 105 may include colorations such as, but not limited to, amber, green, or smoke gray. These tints may enhance image contrast, reduce eye fatigue, and improve visibility in specific lighting environments. For example, amber tinting may improve target outline definition in forested or shadowed terrain, while green tinting may reduce glare under bright sky conditions.

To support modularity and user-specific customization, the diopter lens 104 may be installed within a removable cartridge 106 in one embodiment, such that it can be removed from the housing 102, as seen in FIG. 2. In another embodiment, the lens 104 is fixedly attached within the housing 102. The cartridge 106 may serve as a self-contained lens holder that aligns the lens 104 precisely within the housing 102. The connection between the cartridge 106 and the housing 102 may be secured using a fastener 108, such as, but not limited to, a magnetic retention ring for tool-free installation, a bayonet-locking interface with tactile click stops, a twist-lock mechanism with indexed notches to prevent rotational slippage, etc.

For users requiring more precise optical tuning, one embodiment of the device 100 may include a micro-adjustment ring 110 integrated concentrically with the lens 104. The micro-adjustment ring 110 may allow continuous or indexed rotation of the lens 104, enabling fine diopter adjustments in increments of ±0.25 diopters or finer. The adjustment ring 110 may be fabricated from rigid materials such as anodized aluminum, glass-filled nylon, or stainless steel to preserve calibration over repeated use. The outer surface of the ring 110 may be comprised of a grip area 112 in the form of knurling, ridges, or rubber overmolding to enhance grip and facilitate operation under adverse conditions, including gloved or wet-hand scenarios.

To maintain consistent optical performance in challenging environments, the diopter lens 104 may be treated with multiple coatings, as seen in FIG. 2. An anti-fog coating 114 may be applied to the inner lens surface to inhibit moisture condensation due to temperature changes. A hydrophobic outer coating 116 may repel water droplets, improving clarity during rain or snow exposure. A hard-coated layer 118 may be applied to resist surface abrasions from dust, debris, or contact with cleaning tools. These coatings may be applied in multilayer deposition formats to maintain durability without degrading optical transmission.

A protective flip-up cap 120 may be integrated into or mounted onto the housing 102 in one embodiment to shield the lens 104 from contaminants such as dust, mud, or particulate matter during transport or periods of non-use, as seen in FIG. 1 and FIG. 2. The cap 120 may operate on a silent hinge mechanism 122, which may include a spring-damped or friction-based articulation to allow quiet, single-handed actuation. The hinge mechanism 122 may incorporate a detent or over-center locking geometry to hold the cap 120 securely in both open and closed positions. A locking feature 124 may be included in one embodiment to prevent accidental opening during movement or storage, which may involve a snap latch, magnetic closure, or twist-to-lock interface.

Overall, the device 100 may offer a user-friendly, rugged, and ergonomically optimized solution for enhancing rifle scope clarity across various field scenarios. By providing modular lens options, resistance to environmental conditions, and tool-free adjustability, the device 100 may accommodate a broad spectrum of user vision profiles and shooting environments.

Figure 3:
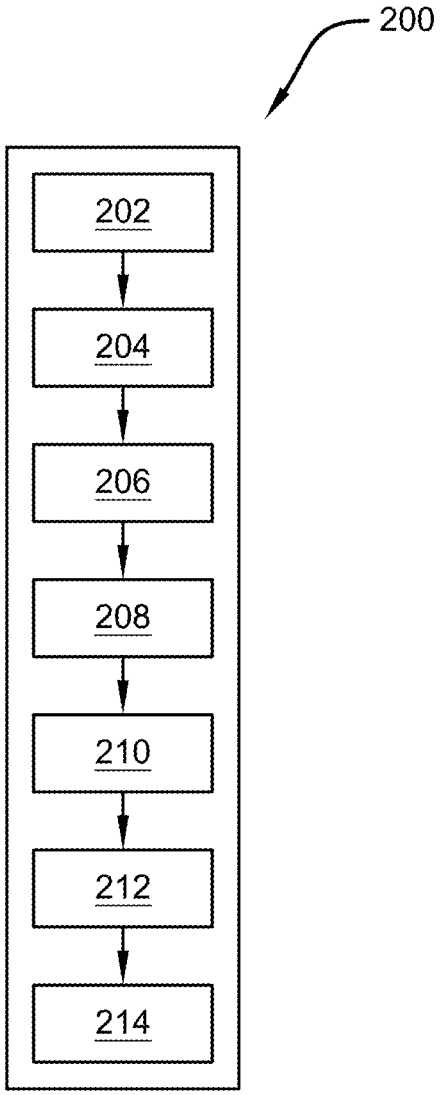
FIG. 3 illustrates a flowchart of a method of using one potential embodiment of a firearm-scope-attachable diopter lens device of the present invention in accordance with the disclosed architecture.

The present invention is also comprised of a method of using 200 the device 100, as seen in FIG. 3. First, a device 100 is provided comprised of a housing 102 comprised of a snap-fit attachment feature 103, at least one optically-aligned diopter lens 104, and a protective flip-up cap 120 with hinge mechanism 122 and locking feature 124 [Step 202]. Then, the housing 102 is aligned with the eyepiece of a standard firearm scope, and the snap-fit attachment feature 103 is engaged such that the housing 102 securely affixes to the scope without requiring modification to the scope [Step 204]. Next, if included, a removable cartridge 106 containing the desired diopter lens 104 may be inserted into the housing 102 and secured using a fastener 108 such as a magnetic retention ring, bayonet-locking interface, or twist-lock mechanism [Step 206]. Then, if included, a micro-adjustment ring 110 is rotated to fine-tune the diopter setting of the lens 104, enabling optical calibration in increments of ±0.25 diopters or finer [Step 208]. Afterward, the protective flip-up cap 120 is closed over the lens 104 and secured using the locking feature 124, if included, to prevent contamination or damage during transport [Step 210]. When preparing to use the scope, the flip-up cap 120 is opened via the hinge mechanism 122 and retained in the open position by the detent or over-center lock geometry [Step 212]. Finally, the user sights through the device 100 with corrective vision provided by the diopter lens 104, thereby eliminating the need for external eyewear during shooting activities [Step 214].

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "firearm-scope-attachable diopter lens device" and "device" are interchangeable and refer to the firearm-scope-attachable diopter lens device 100 of the present invention.

Notwithstanding the foregoing, the firearm-scope-attachable diopter lens device 100 of the present invention and its various components can be of any suitable size and configuration as is known in the art without affecting the overall concept of the invention, provided that they accomplish the above-stated objectives. One of ordinary skill in the art will appreciate that the size, configuration, and material of the firearm-scope-attachable diopter lens device 100 as shown in the FIGS. are for illustrative purposes only, and that many other sizes and shapes of the firearm-scope-attachable diopter lens device 100 are well within the scope of the present disclosure. Although the dimensions of the firearm-scope-attachable diopter lens device 100 are important design parameters for user convenience, the firearm-scope-attachable diopter lens device 100 may be of any size, shape, and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A firearm-scope-attachable diopter lens device comprising:

a housing configured to fit over an eyepiece of a firearm scope without requiring modification to the firearm scope;

a diopter lens mounted within the housing and having a micro-adjusting ring; and a protective flip-up cap attached to the housing and configured to shield the diopter lens from contaminants.

2. The firearm-scope-attachable diopter lens device of claim 1, wherein the housing is comprised of a snap-fit attachment feature.

3. The firearm-scope-attachable diopter lens device of claim 1, wherein the snap-fit attachment feature is comprised of an annular retention lip or an inward-projecting tab.

4. The firearm-scope-attachable diopter lens device of claim 1, wherein the diopter lens is comprised of a tinting.

5. The firearm-scope-attachable diopter lens device of claim 4, wherein the tinting is comprised of an amber, a green, or a smoke grey.

6. The firearm-scope-attachable diopter lens device of claim 1, wherein the micro-adjustment ring adjusts the diopter lens in increments of ±0.25 diopters or finer.

7. The firearm-scope-attachable diopter lens device of claim 1, wherein the diopter lens is comprised of an anti-fog coating.

8. The firearm-scope-attachable diopter lens device of claim 1, wherein the diopter lens is comprised of a hydrophobic outer coating.

9. A firearm-scope-attachable diopter lens device comprising:

a housing configured to fit over an eyepiece of a firearm scope without requiring modification to the firearm scope;

a diopter lens mounted within a removable cartridge attachable to the housing via a fastener and having a micro-adjustment ring; and a protective flip-up cap attached to the housing and configured to shield the diopter lens from contaminants.

10. The firearm-scope-attachable diopter lens device of claim 9, wherein the fastener is comprised of a magnetic retention ring.

11. The firearm-scope-attachable diopter lens device of claim 9, wherein the fastener is comprised of a bayonet-locking interface.

12. The firearm-scope-attachable diopter lens device of claim 9, wherein the fastener is comprised of a twist-lock mechanism.

13. The firearm-scope-attachable diopter lens device of claim 9, wherein the diopter lens is comprised of a tinting.

14. The firearm-scope-attachable diopter lens device of claim 13, wherein the tinting is comprised of an amber, a green, or a smoke grey.

15. The firearm-scope-attachable diopter lens device of claim 9, wherein the micro-adjustment ring adjusts the diopter lens in increments of ±0.25 diopters or finer.

16. The firearm-scope-attachable diopter lens device of claim 9, wherein the diopter lens is comprised of an anti-fog coating.

17. The firearm-scope-attachable diopter lens device of claim 9, wherein the diopter lens is comprised of a hydrophobic outer coating.

18. A method of using a firearm-scope-attachable diopter lens device, the method comprising:

providing a firearm-scope-attachable diopter lens device comprised of a housing, a diopter lens, and a protective cap;

aligning the housing with an eyepiece of a firearm scope and affixing the housing to the firearm scope;

sighting through the eyepiece-mounted optical accessory with corrective vision provided by the diopter lens; and rotating a micro-adjustment ring concentrically integrated with the diopter lens to fine-tune the diopter setting.

* * * * *